United States Patent [19]

Herring

[11] Patent Number: 4,782,733

[45] Date of Patent: Nov. 8, 1988

[54] DOUBLE DRUM BEATER

[76] Inventor: Michael H. Herring, 3 Melrose Street, Modbury Heights, Australia, 5092

[21] Appl. No.: 124,837

[22] Filed: Nov. 24, 1987

[30] Foreign Application Priority Data

Nov. 24, 1986 [AU] Australia ..... PH9127

[51] Int. Cl.[4] ..... G10D 13/02

[52] U.S. Cl. ..... 84/422 R

[58] Field of Search ..... 84/422

[56] References Cited

U.S. PATENT DOCUMENTS

| | | | |
|---|---|---|---|
| 2,484,302 | 10/1949 | Laverents | 84/422 R |
| 2,845,830 | 8/1958 | Haviland | 84/422 R |
| 3,030,847 | 4/1962 | Thompson | 84/422 R |
| 3,722,349 | 3/1973 | Hoellerich | 84/422 R |
| 3,988,957 | 11/1976 | Escamilla | 84/422 R |
| 4,188,853 | 1/1980 | Bills | 84/422 R |
| 4,644,842 | 2/1987 | Aluisi | 84/422 R |

*Primary Examiner*—Lawrence R. Franklin

*Attorney, Agent, or Firm*—Klauber & Jackson

[57] ABSTRACT

Two beaters are so coupled to a foot pedal that they oscillate independently out of phase with each other, one beater being a primary beater and pivotal movement thereof being achieved by depressing a foot pedal, the other beater being a secondary beater, and pivotal movement of the secondary beater being effected by means of a return spring coupled to the foot pedal.

8 Claims, 2 Drawing Sheets

DOUBLE DRUM BEATER

This invention relates to the drum beater arrangement wherein there is a requirement for double beating.

BACKGROUND OF THE INVENTION

When there is a requirement for bass drum double beating, the most usual arrangement is to have two bass drums each entirely independent of the other, and each actuated by an independent foot pedal. Because of the inconvenience, it has also been proposed to arrange a single bass drum to be subjected to the beating of two beaters, but these are also arranged with independent foot pedals.

The closest prior art known to the Applicant are manufactured in Japan by Pearl Musical Instrument Co., Sumida-Ku, Tokyo, Japan and by Tama Drum Co., Shumaku/Bho, Nagoya, Japan and sold under the respective Trade Marks PEARL P-850 and TAMA. Both of these, however, utilise the above described independent foot pedals, and in all instances known to the Applicant the double beating has been effected only by use of both feet, and yet it is clearly desirable that a drummer should be free to have a second foot available for the pedal operation of other instruments, for example percussion instruments of a different type.

BRIEF SUMMARY OF THE INVENTION

The main object of this invention is to provide an improvement whereby a double beat of a drum can be effected by single foot operation on the part of an operator, and in this invention, two beaters are so coupled to a foot pedal that they oscillate independently out of phase with each other, one beater being a primary beater and pivotal movement thereof being achieved by depressing a foot pedal, the other beater being a secondary beater, and pivotal movement of the secondary beater being effected by means of a return spring coupled to the foot pedal.

More specifically a double drum beater according to this invention consists of a base frame, a post upstanding from the base frame near a first end thereof, a foot pedal overlying the base frame, pivot means joining an end of the foot pedal to the base frame near a second end thereof for pivotal movement about a transverse axis, a transverse pivot bar carried by the post, a pair of spaced beater arms carried by the pivot bar for oscillatory movement about the transverse axis thereof, beater balls on respective said beater arms, coupling means coupling the foot pedal to the beater arms in such a way that they oscillate at the same frequency but out of phase with each other upon depression of the foot pedal, and a return spring co-operable between the beater arms and the base frame to effect reverse oscillation upon release of the foot pedal, such that a foot pedal depression drives one beater ball in a drum beating direction and the return spring drives the other beater in that direction upon release of the foot pedal Various embodiments of the invention can be devised. For example, in one embodiment the primary and secondary beaters are moved by means of a reciprocating bar which is depressed downwardly by means of actuation of the foot pedal and returned by a spring. The spring return effects the beating movement of the secondary beater.

In many drum pedal beaters, instead of linkages being used, sprockets and chains, or drums and straps are used, and the invention is equally applicable to such an arrangement which, for the purposes of this description, is regarded as the equivalent of the linkage arrangement shown. If for example the invention is applied to a foot pedal arrangement utilising a sprocket and chain (or drum and strap) then use could be made of two sprockets on a single shaft, the chain being coupled to the foot pedal from the right hand side of one sprocket which carries on it the primary beater stem, and the return spring causing actuation of the secondary beater stem by a secondary chain coming from the other side of the secondary sprocket. Alternatively, the sprockets can be on spaced shafts coupled together by gears.

DETAILED DESCRIPTION OF THE PREFERRED EMBODIMENT

The preferred embodiment of the invention is described hereunder in some detail with reference to, and is illustrated in, the accompanying drawings, in which.

Figure 2:
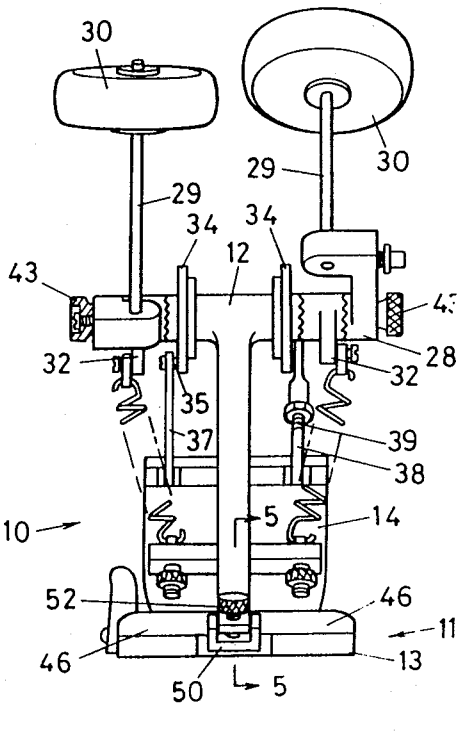
FIG. 2 is an end elevation of FIG. 1.
Figure 1:
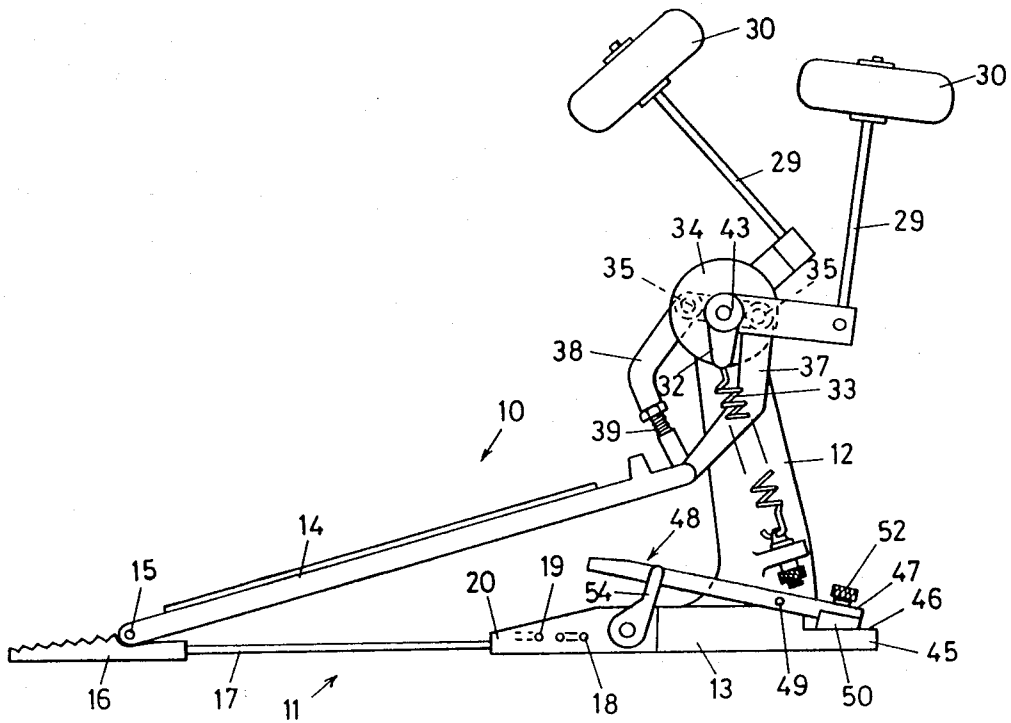
FIG. 1 is a side elevation of a double drum beater.

In this embodiment a double beater 10 comprises a three-part base frame 11 which has a post 12 upstanding from its first end 13, a foot pedal 14 overlying the base frame 11, and a pivot pin 15 which connects an end of the foot pedal to a second end 16 of the base frame 11.

The first end and second end of the base frame 11 are joined by an intermediate portion 17 which comprises a pair of rods the ends 18 of which are directed outwardly and snap into selected ones of holes 19 in rearwardly facing lugs 20 of the first end 13. This not only provides an adjustment for effective length of the foot pedal 14 but also provides some articulation of the first end 13 with respect to the second end 16.

The upper end of the post 12 has a boss through which extends a transverse pivot bar 24, the pivot bar 24 projecting from each side of the post. Each projecting side of the pivot bar carries on it a group of three bearings designated 25, 26 and 27, and the first bearings 25 carry on them beater arm bosses 28, each beater arm boss 28 supporting the lower end of a beater arm 29 which carries a beater ball 30 on its upper end. Inwardly of the beater arm bosses 28 there are provided spring arms 32 each of which supports a spring 33 on the end of the arm, the spring arms 32 being carried by the respective bearings 26 which are sleeve bearings.

Inwardly again from the spring arms 32 there are provided a pair of eccentrics 34 on respective bearings 27, and on one side the eccentric 34 has an eccentric pin 35 disposed forwardly of the axis of the pivot bar 24 while on the other side the eccentric pin 35 is aft of the axis of the pivot bar 10. 24. The eccentric pins 35 are coupled by coupling links 37 and 38 respectively to the forward end (the first end) of the foot pedal 14. One link 37 is of fixed length but the other length 38 is a variable length being provided with an adjusting screw 39 between its ends. Alternatively, the spring arms may be arranged to compress springs, and also be coupled to the beater coupling links.

Figure 4:
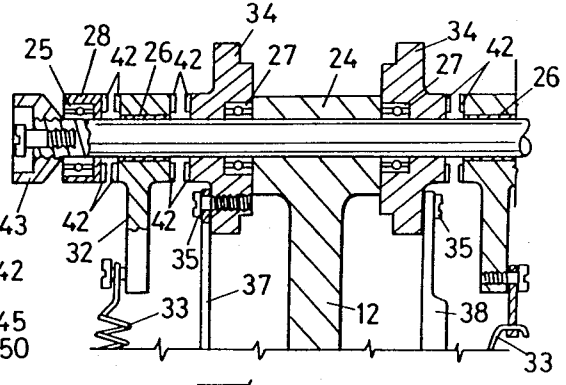
FIG. 4 is a part section taken on line 4—4 of FIG. 3.
Figure 5:
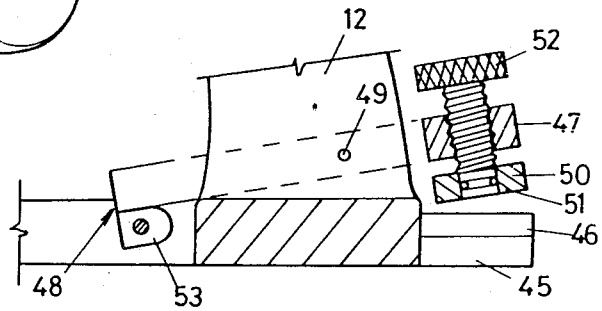
FIG. 5 is a part section taken on line 5—5 of FIG. 2, FIGS. 4 and 5 being drawn to a larger scale.
Figure 3:
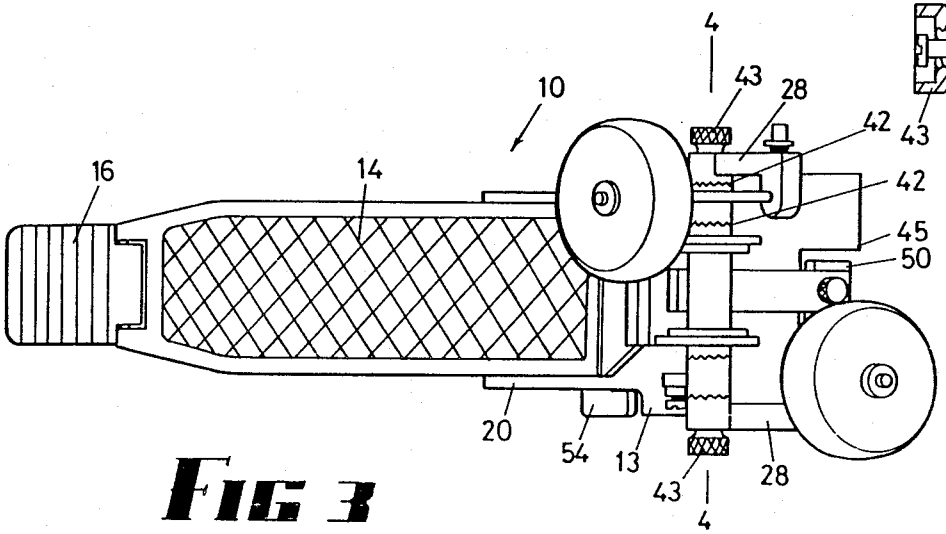
FIG. 3 is a plan of FIG. 1.

It is desirable that adjustment be provided for the positioning of the coupling links, the springs and the beater arms, and to this end, only the eccentrics 34 are incapable of slidable movement over the pivot bar 24, oscillatory elements 28 and 32 being both slidable and rotational. The contiguous faces of these elements are provided with interengaging surfaces, in this embodiment being serrated surfaces all of which are designated 42, and there are also provided clamping screws 43 which threadably engage the ends of the pivot bar 24 in a screw/nut configuration as best seen in FIG. 4. When the screws are slackened, the serrated surfaces can come apart and the oscillatory members can be adjusted with respect to one another, while when they are tightened the beater arm bosses 28, the spring arms 32 and the eccentrics 34 on each side of the post 12 are interconnected to oscillating units. Oscillation is so adjusted that when the foot pedal 14 is depressed one beater ball 30 is driven in a drum beating direction while the other beater ball 30 moves at the same frequency but out of phase therewith, and when the foot pedal 14 is released the springs 33 function as return springs to effect a reverse oscillation so that the second beater ball moves in a drum beating direction and the first moves in the opposite direction.

In order to retain the beater 10 with respect to a drum, the beater 10 is provided with a pair of lugs 45 which extend forwardly from the first end 13 of the base frame 11, each lug 45 having a drum rim support surface 46, but the two surfaces are spaced apart from one another and accommodate a drum rim engaging end 47 of a fork-shaped clamping bar 48 which has two limbs straddling eachside of the post 12 and pivoted thereto on a pivot pin 49. The end 47 is also provided with a clamping plate 50 the undersurface 51 of which forms a rim engaging surface for clamping the rim to the support surfaces 46. A threaded member 52 provides adjustment, but for quick action clamping there is provided a cam 53 which is finger operated by means of a lever 54 to cause the required pivotal movement of the clamping bar 48.

A consideration of the above embodiment will indicate that although the beater 10 is a simple device it nevertheless provides means whereby a musician can effect a double beat of a bass drum without the need to use two feet. Further, it will be seen that the double beater of the invention avoids the need for a second drum.

I claim:

1. A double drum beater comprising a base frame, a post upstanding from the base frame near a first end thereof, a foot pedal overlying the base frame, pivot means joining an end of the foot pedal to the base frame near a second end thereof for pivotal movement about a transverse axis, a transverse pivot bar carried by the post, a pair of spaced beater arms carried by the pivot bar for oscillatory movement about the transverse axis thereof, beater balls on respective said beater arms, coupling means coupling the foot pedal to the beater arms in such a way that they oscillate at the same frequency but out of phase with each other upon depression of the foot pedal, and a return spring co-operable between the beater arms and the base frame to effect reverse oscillation upon release of the foot pedal, such that a foot pedal depression drives one beater ball in a drum beating direction and the return spring drives the other beater in that direction upon release of the foot pedal.

2. A double drum beater according to claim 1 wherein there is one only said post upstanding from the base frame, said pivot bar is fixed with respect to that post near its upper end and projects from each side thereof, and bearings on the pivot bar, each said beater arm being carried on at least one of said bearings for its oscillatory movement.

3. A double drum beater according to claim 2 further comprising a pair of eccentric members each carried on at least one of said bearings on respective sides of the post, and adjustment means joining each said beater arm to a respective said eccentric member, said coupling means comprising links extending between the foot pedal and respective said eccentric members.

4. A double drum beater according to claim 1 further comprising two groups each of three bearings on said pivot bar, a pair of beater arm bosses respectively on first corresponding bearings of each said group, said beater arms being carried by respective said bosses, a pair of spring arms respectively on second corresponding bearings of each said group, there being two said return springs one end each of which engages a respective said spring arm, a pair of eccentrics respectively on third corresponding bearings of each said group, said coupling means comprising a pair of links each connecting the foot pedal to a respective said eccentric but fore and aft of the pivot bar so that pivotal movement of the foot pedal in one direction drives one beater in a drum beating direction and the other beater in a reverse direction, engagement faces on the beater arm bosses, the spring arms and the eccentrics of each said group, and clamp means releasably retaining contiguous engagement faces against relative rotation.

5. A double drum beater according to claim 4 wherein respective said bearings carry the beater arm bosses and the spring arms both for oscillatory movement about and sliding movement along the pivot bar, and said clamp means comprise clamping screws threadably engaging the ends of the pivot bar.

6. A double drum beater according to claim 1 further comprising a clamping bar, pivot means joining the clamping bar to the post near its lower end, a clamping surface on one end of the clamping bar, a drum rim support surface outstanding from the first end of the base frame, and a cam carried by the base frame so engageable against the clamping bar as to urge the clamping surface thereof downwardly towards the drum rim support surface.

7. A double drum beater according to claim 6 further comprising a clamping plate, screw threaded adjustment means joining the clamping plate to said end of the clamping bar, said clamping surface being an under-surface of the clamping plate.

8. A double drum beater according to claim 1 wherein the base frame comprises a first end portion at its said first end, a second end portion at its said second end, and an intermediate portion joining the end portions for relative articulation thereof.

* * * * *